United States Patent [19]

Singer

[11] 4,058,222

[45] Nov. 15, 1977

[54] MULTIPLE CLOTHES HANGING DEVICE

[76] Inventor: Evelyn R. Singer, 3450 Sawtelle Blvd., Los Angeles, Calif. 90066

[21] Appl. No.: 712,018

[22] Filed: Aug. 5, 1976

[51] Int. Cl.[2] ..... A47F 7/19

[52] U.S. Cl. ..... 211/118; 211/49 R; 223/92

[58] Field of Search ..... 223/68, 69, 85–96; 211/113–119, 49, 40, 43, 46, 99, 100, 94, 162; 248/122, 125, 214–216, 222.3, 225.4, 244–246, 239, 286, 295, 297, 301, 307, 317, 339–341; 16/87.4, 93; 403/353

[56] References Cited

U.S. PATENT DOCUMENTS

| | | | |
|---|---|---|---|
| 1,034,365 | 7/1912 | Hauser | 248/246 |
| 1,808,628 | 6/1931 | Bond | 248/214 X |
| 2,158,616 | 5/1939 | Blameuser | 211/100 |
| 2,303,678 | 12/1942 | Bracken et al. | 223/88 |
| 2,557,627 | 6/1951 | Bari | 211/113 |
| 2,645,355 | 7/1953 | Evans | 211/99 X |
| 2,998,903 | 9/1961 | Day | 223/92 X |
| 3,584,746 | 6/1971 | Marchman | 211/116 |
| 3,952,906 | 4/1976 | Georgopulos | 211/49 R X |

FOREIGN PATENT DOCUMENTS

| | | | |
|---|---|---|---|
| 1,064,147 | 12/1953 | France | 211/113 |
| 674,400 | 10/1929 | France | 223/92 |
| 1,107,638 | 8/1955 | France | 223/92 |
| 228,415 | 11/1910 | Germany | 223/92 |
| 85,144 | 4/1957 | Netherlands | 223/92 |

*Primary Examiner*—Roy D. Frazier
*Assistant Examiner*—Terrell P. Lewis
*Attorney, Agent, or Firm*—Fred N. Schwend

[57] ABSTRACT

A multiple garment hanging device embodying a vertically supported elongate track member. A plurality of hanger slides, each carrying a garment hanger, are slideably mounted on the track member and limit against each other, the lower most one limiting against a stop on the member. By rocking a hanger slide carrying a selected garment, the slide and garment may be removed from the track member.

9 Claims, 5 Drawing Figures

MULTIPLE CLOTHES HANGING DEVICE

BACKGROUND OF THE INVENTION

1. Field of the Invention

This invention relates to garment hanging devices and has particular reference to devices which include a plurality of garment hangers carried by a single hook member or the like.

2. Description of the Prior Art

Garment hanging devices are known which comprise a multiplicity of hangers supported from a single hook whereby a number of garments can be suspended in overlapping relation to each other. Such garment hanging devices have the advantage that they enable a much greater number of garments to be hung in a given closet space than is possible with the usual single garment hangers. However, those multiple hanger devices of which I am aware are generally inconvenient to handle, primarily because of the accumulated weight of a number of garments supported thereby and the overlapping relation of such garments. This makes it difficult to remove a selected garment which lies between or under other overlapping garments.

In order to overcome this defect, multiple garment hanging devices have been developed in which a series of hooked garment hangers are removably suspended one from another in the manner of a chain in order to support a number of overlapping garments. Although this type of multiple hanging device is superior in that a selected hanger and garment supported thereby may be removed from the rest of the garments, the weight of the remaining hangers and garments supported thereby make it difficult and awkward to handle such remaining hangers and garments and to reassemble the same.

SUMMARY OF THE INVENTION

A principal object of the present invention is to provide a multiple garment hanging device for a plurality of garments in which any selected garment hanger and garments carried thereby may be easily and quickly removed.

Another object is to facilitate mounting a garment hanger and garment carried thereby onto a multiple garment hanging device.

According to the present invention, a garment hanging device for a plurality of garments is provided comprising an elongate track member having means for suspending the same from a garment supporting rail or the like. A plurality of slides, each comprising or carrying a garment hanger, are slidably mounted on the track member, one bearing on top of another. Each slide and its associated hanger may be removed from the track member independently of the remaining slides by merely rocking the selected slide a predetermined amount, permitting the same to be withdrawn. Those slides located above the withdrawn slide will merely slide down the track member to fill the gap. The removed slide with a garment thereon may be easily and readily remounted at the top of the track member without having to lift any of the remaining slides.

BRIEF DESCRIPTION OF THE DRAWINGS

The manner in which the above and other objects of the invention are accomplished will be readily understood on reference to the following specification when read in conjunction with the accompanying drawing, wherein.

DESCRIPTION OF THE PREFERRED EMBODIMENT

Figure 1:
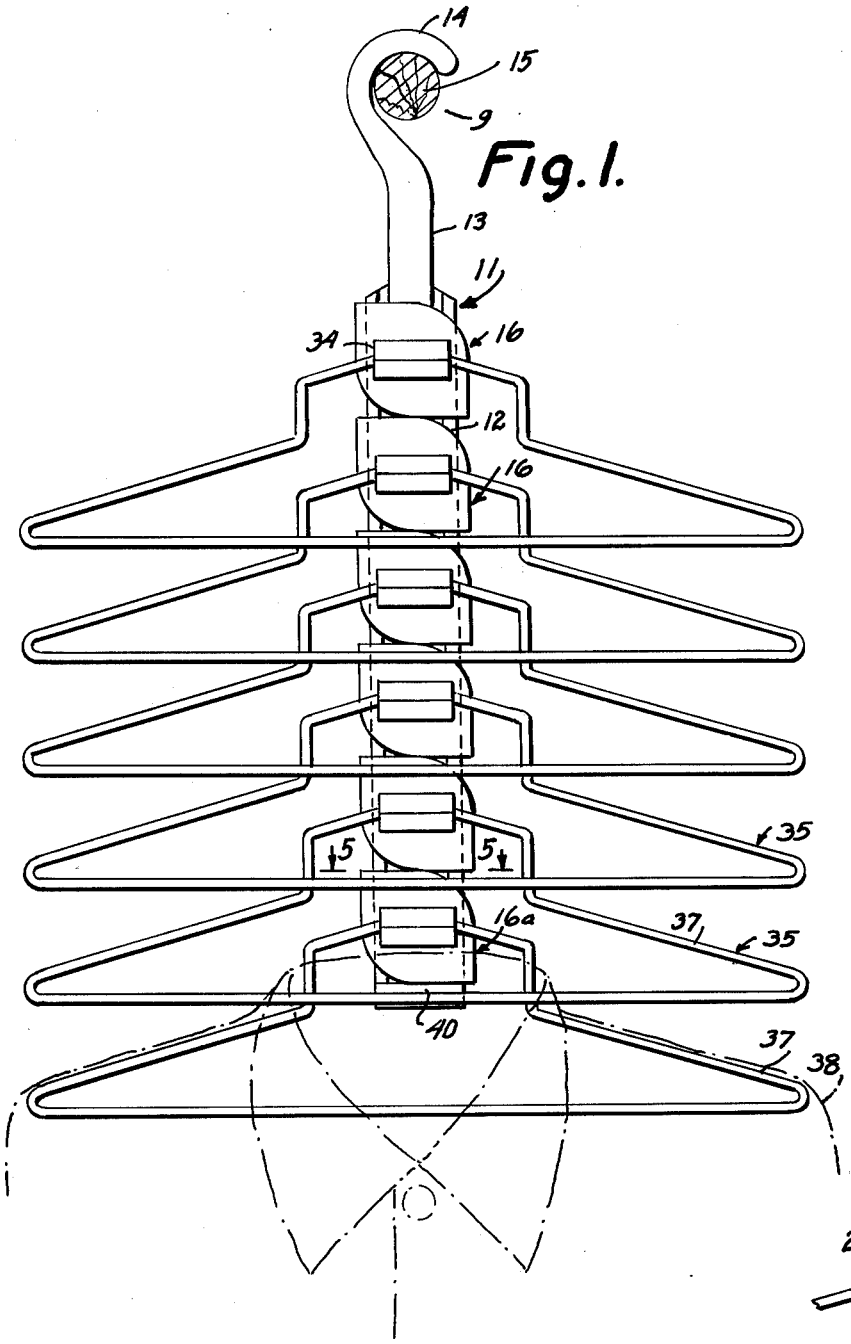
FIG. 1 is a front view of a multiple garment hanging device embodying a preferred form of the present invention.
Figure 2:
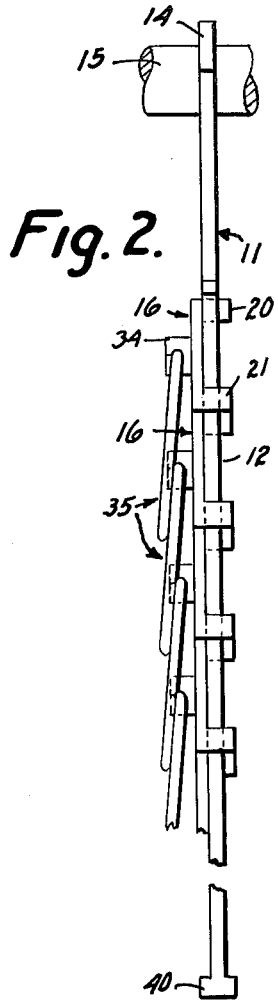
FIG. 2 is a side view of the device with parts broken away.

Referring to the drawing, the hanger device comprises an elongate track member generally indicated at 11 and preferably formed of plastic. The member 11 comprises a main or track section 12 of rectangular cross-section, an intermediate loading section 13 which is also of rectangular cross-section but of less width than the track section 12, and an upper hook section 14. The latter is adapted to be suspended on a horizontal garment rail or rod 15, such as is found in the usual clothes closet. It will be noted that the hook section 14 is so formed that the remainder of the track member will be suspended vertically when hanging from the rail 15 or from any other suitable support.

Figure 4:
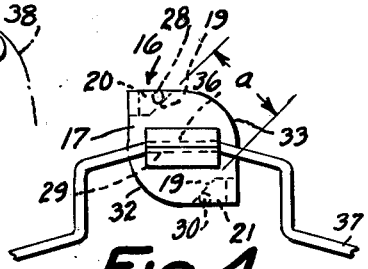
FIG. 4 is a front view of one of the hanger slides.
Figure 5:
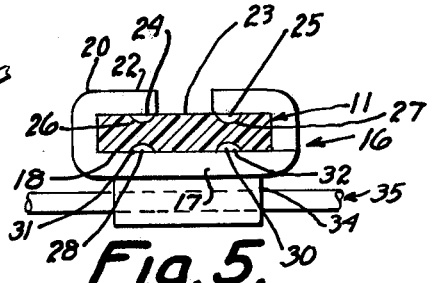
FIG. 5 is an enlarged sectional plan view and is taken alond the line 5—5 of FIG. 1.

A plurality of hanger slides, generally indicated 16, are slideably mounted on the track section 12 of member 11. As seen particularly in FIGS. 4 and 5, each hanger slide 16 is preferably formed of a flexible plastic material and comprises a substantially square main section 17 adapted to slideably engage the front surface 18 of the member 11. Retaining tabs 20 and 21 are integrally formed on diagonally opposed corners of the slide. Such tabs are "L" shaped when viewed in plan and each has a guide portion 22 which normally slideably engages the rear surface 23 of the track section 12 of member 11 to retain the slide in place. The edge of each tab section 22 is bevelled at 19 and the distance "*a*" between such bevelled edges 19 of tabs 20 and 21 is slightly larger than the width of the track section 12 of member 11.

Dimples 24 and 25 are formed on respective ones of the tabs 20 and 21 and such dimples normally slideably engage in respective grooves 26 and 27 formed in the rear side 23 of member 11. Grooves 26 and 27 extend the entire length of the track section 12. Similar dimples 28 and 30 are formed on the hanger slide in alignment with dimples 24 and 25, respectively, and are likewise normally slideable in grooves 31 and 32, respectively, formed in the forward side 18 of track section 12. Such grooves also extend the entire length of section 12.

It will be noted that the grooves 28 and 30 are in alignment with the grooves 24 and 25.

The opposite diagonally opposed corner edges of each slide 16 are curved at 32 and 33. Preferably, such edges are formed as arcs extending concentrically about the center of the slide. Each hanger slide 16 has a bearing boss 34 formed on the forward side thereof to pivotally support a triangular hanger 35 for swinging movement about a horizontal axis. The hanger 35 is formed of relatively stiff wire and has a section 29 journaled in a horizontally extending bearing 36 formed in the boss 34. The hanger 35 is bent to form downwardly diverging hanger arms 37 on which a garment, as indicated by dot-dash lines 38, may be mounted.

Figure 3:
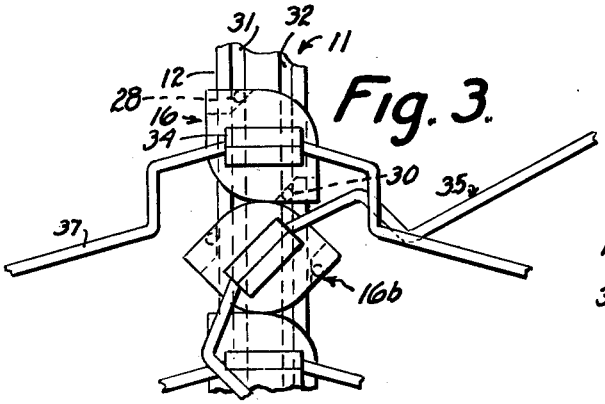
FIG. 3 is a fragmentary front view, similar to the FIG. 1, but illustrating one of the hanger slides rocked into position to allow the same to be removed.

To facilitate mounting the hanger 35 in bearing 36, the bearing boss 34 is slit at 39, enabling the same to be spread apart so that the section 29 may be inserted laterally into the bearing 36. In use, the hanger slides 16, either with or without garments supported thereby, are mounted on the track member 11 by fitting the same against the forward surface 18 of the loading section 13 and then allowing them to move downwardly into sliding engagement with the main track section 12. The dimples 24, 25, 28 and 30 prevent inadvertent rocking of the hanger slides as they move along the track section 12. The lowermost hanger slide, i.e. 16*a* limits against a projecting stop 40 formed on the lower end of the track member 11. The remaining hanger slides, each rests against the next adjacent lower hanger slide and thus the slides equally space the hangers 35 and any garments supported thereby in overlapping relation, one partly above the other. When it is desired to remove a selected garment, the hanger slide 16 carrying the same is rocked counter clockwise approximately 45 degrees into the position shown at 16*b*, FIG. 3, until the bevelled edges 19 of the tabs 20 and 21 become vertically aligned with the opposite edges of the track member 11, at which time the slide may be easily withdrawn. During such rocking movement the guide dimples 24, 25, 28 and 30 will snap out of their respective guide grooves due to the resiliency of the plastic material forming the slides 16. Since the arcuate edges 32 and 33 are concentric, no camming movement will be imparted to the remaining slides 16 located above that slide being rocked. The remaining hanger slides 16 located above that being removed will then merely slide down member 11 under the influence of gravity to fill the gap.

In order to replace the removed hanger slide 16, with or without a garment supported thereby, such slide is merely placed against the loading section 13 in a horizontal position and then allowed to move downward into sliding engagement with the main track section 12 as described heretofore.

Due to the symmetrical arrangement of the various guide grooves 26, 27, 31 and 32 in the track member 11, the hanger slides 16 may be mounted on either the forward face 18 or the rear face 23 of the member. Thus, the open part 9 of the hook section 14 may face either in the direction shown in FIG. 1 or in the opposite direction.

It will be obvious to those skilled in the art that many variations may be made in the exact structure shown without departing from the spirit of this invention. For example, although the track member 11 and slides 16 are formed of plastic, they could also be made of metal or other materials. Also, the hangers 35 could be made of plastic or other materials.

I claim:

1. A multiple garment hanging device comprising
an elongate track member,
means for supporting said track member in the vertical position,
means on said track member forming a stop,
a plurality of slides slideable along one side of said track member,
one of said slides being effective to limit against said stop,
the others of said slides being effective to limit against one another,
garment hangers supported by said slides, and
retaining means on each of said slides,
said retaining means slideably engaging said track member to normally retain said respective slide on said track member,
each of said slides being rockable in a plane parallel to the length of said track member to release said retaining means thereof from said track member whereby said rocked slide may be withdrawn from said one side of said track member independently of the remaining ones of said slides.

2. A multiple garment hanging device as defined in claim 1 wherein said retaining means comprises
retaining tabs on diagonally disposed corners of each of said slides,
said tabs normally slideably engaging said track member to prevent removal of said slides from said track member,
each of said slides being rockable to remove said tabs from sliding engagement with said track member.

3. A multiple garment hanging device as defined in claim 2 wherein said track member has a guideway extending along the length thereof,
said tabs being yieldable, and
guide means on each of said tabs slideably engaging said guideway,
said tabs yielding upon said rocking of said slides whereby to release said guide means from said guideway.

4. A multiple garment hanging device as defined in claim 2 wherein said slides slideably engage one side of said track member and wherein said retaining means comprises
retaining tabs on diagonally disposed corners of said slides,
said tabs normally slideably engaging the opposite side of said track member,
each of said slides being rockable in a plane parallel to the plane of said track member to remove said tabs from sliding engagement with said track member whereby said last mentioned slides may be removed from said track member.

5. A multiple garment hanging device as defined in claim 2 wherein the opposite diagonally disposed corners of each of said slides comprise arcuate surfaces engageable with adjacent ones of said slides upon said rocking of a said slide.

6. A multiple garment hanging device as defined in claim 5 wherein said arcuate surfaces are concentric with the centers of said slides.

7. A multiple garment hanging device as defined in claim 2 wherein said track member has a pair of grooves extending along the length thereof on one side thereof,
said tabs being yieldable, and
runners on said tabs normally slideably engaging in said grooves,
said tabs yielding upon said rocking of said slides whereby to release said runners from said grooves.

8. A multiple garment hanging device as defined in claim 2 wherein said track member has grooves extending along the length thereof or opposite sides thereof,
said tabs being yieldable, and
runners on said tabs and on said slides normally slideably engaging in said grooves,
said tabs yielding upon said rocking of said slides whereby to release said runners from said grooves.

9. A multiple garment hanging device as defined in claim 2 wherein said track member has a main section of constant width and a loading section above said main section,
said loading section having a width less than the distance across said tabs as measured in a direction normal to the length of said track member.

* * * * *